US008662091B2

(12) United States Patent
Jang

(10) Patent No.: US 8,662,091 B2
(45) Date of Patent: Mar. 4, 2014

(54) MAKEUP UTENSIL SET FOR DISABLED INDIVIDUALS

(75) Inventor: Sin Ju Jang, Seoul (KR)

(73) Assignee: Amorepacific Corporation, Seoul (KR)

( * ) Notice: Subject to any disclaimer, the term of this patent is extended or adjusted under 35 U.S.C. 154(b) by 0 days.

(21) Appl. No.: 13/504,709

(22) PCT Filed: Oct. 29, 2010

(86) PCT No.: PCT/KR2010/007497

§ 371 (c)(1),
(2), (4) Date: Apr. 27, 2012

(87) PCT Pub. No.: WO2011/053028

PCT Pub. Date: May 5, 2011

(65) Prior Publication Data

US 2012/0216824 A1 Aug. 30, 2012

(51) Int. Cl.

| | |
|---|---|
| ***A45D 40/26*** | (2006.01) |
| ***A45D 33/24*** | (2006.01) |
| ***A45D 33/26*** | (2006.01) |
| ***A45D 40/24*** | (2006.01) |
| ***A46B 5/04*** | (2006.01) |
| ***B65D 69/00*** | (2006.01) |
| ***B65D 71/00*** | (2006.01) |

(52) U.S. Cl.
USPC ..... 132/320; 132/294; 132/314; 132/317; 401/7; 206/581; 206/823

(58) Field of Classification Search
USPC ..... 132/320, 218, 73, 73.5, 75, 75.3, 75.6, 132/76.4, 76.5, 286, 290, 294, 297, 308, 132/312, 313, 314, 317, 318, 333, 321, 132/329; 206/63.5, 581, 823, 361, 362, 206/362.3, 235, 368, 562, 563, 564, 565, 206/822, 486, 385, 575, 1.7, 1.8, 1.9; 15/113, 167.1, 227, 229.3, 229.14, 15/118; 401/6, 7, 8, 9; 2/16, 21, 163; 30/323, 1; 7/121; 223/101; D28/7, 57, D28/61; D24/227, 230; 220/601, 661; 81/177.3; 294/25
See application file for complete search history.

(56) References Cited

U.S. PATENT DOCUMENTS 1,109,796 A * 9/1914 Sills ..... 294/25
1,380,960 A * 6/1921 Hmenia ..... 223/101

(Continued)

FOREIGN PATENT DOCUMENTS

JP 56-111907 U 8/1981
JP 2005-111959 A 4/2005

(Continued)

OTHER PUBLICATIONS

International Search Report PCT/KR2010/007497, Jul. 20, 2011.*

(Continued)

*Primary Examiner* — Vanitha Elgart
(74) *Attorney, Agent, or Firm* — Maxon IP LLC.; Justin H. Kim, Esq.

(57) ABSTRACT

A makeup tool set for a handicapped person. The makeup tool set includes a makeup tool (110), into which a finger is inserted, to apply cosmetics; and a custody case (120) including a seat groove (122) in which the makeup tool (110) is mounted. A hand handicapped person can easily hold a makeup tool to apply color cosmetics for makeup such as eye makeup, lip makeup, and cheek makeup, and can easily keep the makeup tool in the custody.

8 Claims, 2 Drawing Sheets

(56) References Cited

U.S. PATENT DOCUMENTS

| | | | | | |
|---|---|---|---|---|---|
| 2,002,144 | A | * | 5/1935 | Heaton | 132/320 |
| 2,151,846 | A | * | 3/1939 | Greneker | 81/177.3 |
| 2,154,337 | A | * | 4/1939 | King | 132/212 |
| 2,883,691 | A | * | 4/1959 | Gruenwald | 15/167.1 |
| 3,505,700 | A | * | 4/1970 | Rodriguez | 15/160 |
| 3,720,975 | A | * | 3/1973 | Nelson | 15/167.1 |
| D253,010 | S | * | 9/1979 | Gueret et al. | D28/7 |
| 4,177,698 | A | * | 12/1979 | Greneker | 81/177.3 |
| D254,035 | S | * | 1/1980 | Gueret et al. | D28/7 |
| 4,213,472 | A | * | 7/1980 | Gueret et al. | 132/320 |
| 4,412,618 | A | * | 11/1983 | La Conte | 206/581 |
| 4,679,274 | A | * | 7/1987 | Friedman | 15/167.1 |
| 5,033,629 | A | * | 7/1991 | Caine | 211/69.5 |
| 5,045,073 | A | * | 9/1991 | Wagner | 604/310 |
| 5,228,433 | A | * | 7/1993 | Rosen | 601/139 |
| 5,604,952 | A | * | 2/1997 | Zeleznick | 15/167.1 |
| 5,609,165 | A | * | 3/1997 | Lambert | 128/880 |
| 5,678,273 | A | * | 10/1997 | Porcelli | 15/104.94 |
| 5,807,301 | A | * | 9/1998 | Nadam | 604/1 |
| 5,826,599 | A | * | 10/1998 | Adams | 132/308 |
| 5,875,513 | A | * | 3/1999 | Reinold | 15/227 |
| 5,980,960 | A | * | 11/1999 | Amitai | 426/115 |
| 6,116,252 | A | * | 9/2000 | Stelmach | 132/309 |
| 6,527,464 | B2 | * | 3/2003 | Lee | 401/8 |
| 6,726,068 | B2 | * | 4/2004 | Miller | 223/101 |
| 6,997,321 | B2 | * | 2/2006 | Young | 206/581 |
| 7,214,336 | B2 | * | 5/2007 | Sheridan et al. | 264/250 |
| 7,331,450 | B2 | * | 2/2008 | Discko, Jr. | 206/63.5 |
| 7,748,566 | B1 | * | 7/2010 | Mesa | 222/102 |
| 7,789,845 | B1 | * | 9/2010 | Meliti | 604/1 |
| 2006/0243295 | A1 | * | 11/2006 | Petit | 132/320 |
| 2009/0260653 | A1 | * | 10/2009 | Ramos | 132/294 |
| 2010/0088794 | A1 | * | 4/2010 | Oradini, Sr. | 2/21 |
| 2010/0143019 | A1 | * | 6/2010 | Merla, Jr. | 401/7 |

FOREIGN PATENT DOCUMENTS

| | | | |
|---|---|---|---|
| KR | 20-0218237 | Y1 | 3/2001 |
| KR | 10-2008-0006355 | A | 1/2008 |

OTHER PUBLICATIONS

Internationa Search Report Re PCT/KR2010/007497, dated Jul. 20, 2011.

* cited by examiner

MAKEUP UTENSIL SET FOR DISABLED INDIVIDUALS

BACKGROUND OF THE INVENTION

1. Field of the Invention

The present invention relates to a makeup tool set for a handicapped person, and more particularly, to a makeup tool set for allowing a hand handicapped person to hold easily a makeup tool used in smearing and applying cosmetics to face skin for makeup such as eye makeup, lip makeup, cheek makeup, and the like and to have custody of the makeup tool conveniently.

2. Description of the Related Art

In general, makeup is an action of applying cosmetics to human face to appear more beautiful and there are several types of makeup such as cheek makeup, eye makeup, lip makeup, and the like. For makeup, makeup tools suitable for applying color cosmetics to corresponding portion of the face are used.

The makeup tools include brushes to spread and apply cosmetics to a relatively wide area such as cheek softly, sponge tips suitable for applying powder color cosmetics to a portion such as upper eyelids elaborately, and other convenient tool having a structure of easily absorbing liquid color cosmetics to bear the same.

The existing makeup tool includes a brush, an applying tip such as a sponge tip connected to a brush rod of a preset length an rear end of which is provided with a grip held by a user. The makeup tool is kept in a cosmetic case such as a pouch.

However, a hand handicapped person feels difficulty to use this existing makeup tool and the cosmetic case. For example, the above-mentioned makeup tool is held by which a user holds a grip with a thumb and index finger to smear the color cosmetics onto the tip. However, since a finger handicapped person, especially, a handicapped person without a thumb cannot grasp the makeup tool, it is very inconvenient and difficult for the handicapped to use and makeup.

Moreover, it is difficult to keep and take the makeup tool in and out of a custody case such as a pouch as well as it takes a long time to take the makeup tool out of the custody case and to steadily hold the same such that color cosmetics is smeared into the tip, a user cannot makeup promptly.

BRIEF SUMMARY OF THE INVENTION

The present invention has been made to overcome the above problem and provide a makeup tool set having a structure, into which of a finger is inserted, of allowing a hand handicapped person to conveniently and promptly grasp and to conveniently keep in custody.

In order to achieve the foregoing and/or other aspects of the present invention, there is provided a makeup tool set for a handicapped person, including: a makeup tool (110), into which a finger is inserted, to apply cosmetics; and a custody case (120) including a seat groove (122) in which the makeup tool (110) is mounted.

Here, the makeup tool (110) may include: a thimble (112) into which the finger is inserted; a tool rod (114) extending from the thimble (112); and an applying tip (116) formed at an end of the tool rod (114).

Moreover, the thimble (112) may be made of an elastic material.

In addition, the thimble (112) may include an elastic support (118) extending in the direction where the finger is inserted.

The elastic support (118) may have a coil spring-like shape. Moreover, the custody case (120) may have a hollow semi-spherical shape and may include a seat groove (122) formed on the surface thereof in which the makeup tool (110) is mounted and a through-hole (124) formed inward the inside of the custody case (120) in the seat groove (122).

According to the makeup tool set for a handicapped person of the present invention, since a user, particularly a hand handicapped person who cannot grasp the makeup tool 110 applying color cosmetics to corresponding skin can insert a finger into the thimble 112, the hand handicapped person can makeup conveniently without wrapping the makeup tool 110 and can keep the makeup tool 110 conveniently by mounting the thimble 112 in the seat groove 122.

BRIEF DESCRIPTION OF THE DRAWINGS

The objects, features and advantages of the present invention will be more apparent from the following detailed description in conjunction with the accompanying drawings, in which.

DETAILED DESCRIPTION OF THE INVENTION

Particular terms may be defined to describe the invention in the best manner. Accordingly, the meaning of specific terms or words used in the specification and the claims should not be limited to the literal or commonly employed sense, but should be construed in accordance with the spirit of the invention.

Hereinafter, the embodiment of the present invention will be described in detail with reference to the accompanying drawings so that those skilled in the art may easily practice the present invention.

Figure 1:
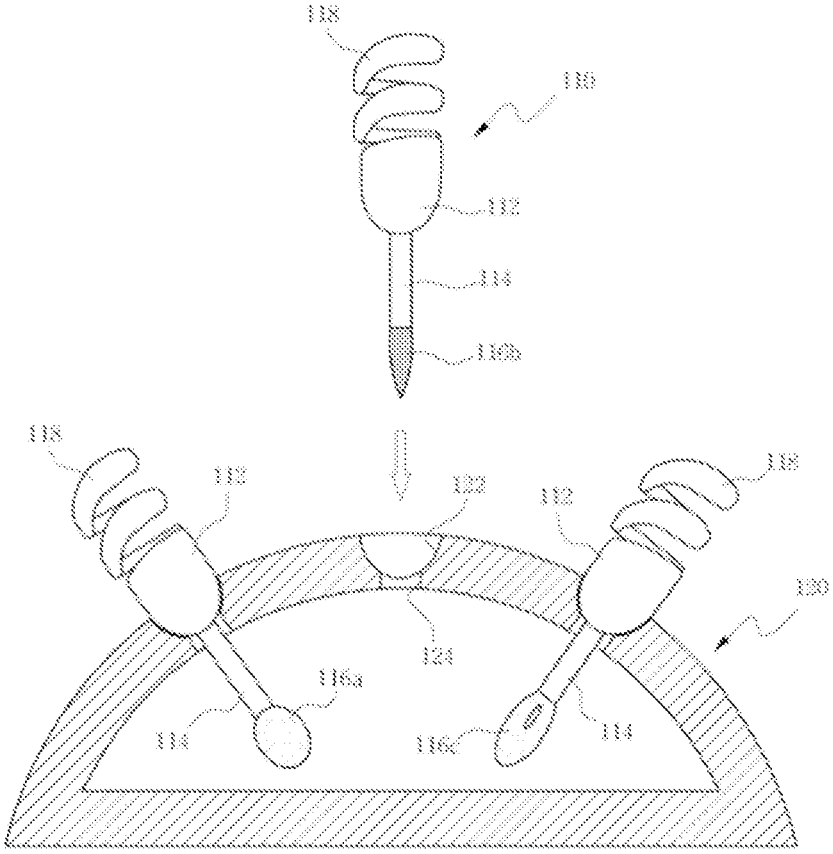
FIG. 1 is a sectional view illustrating a makeup tool set for a handicapper person according to an exemplary embodiment of the present invention.
Figure 2:
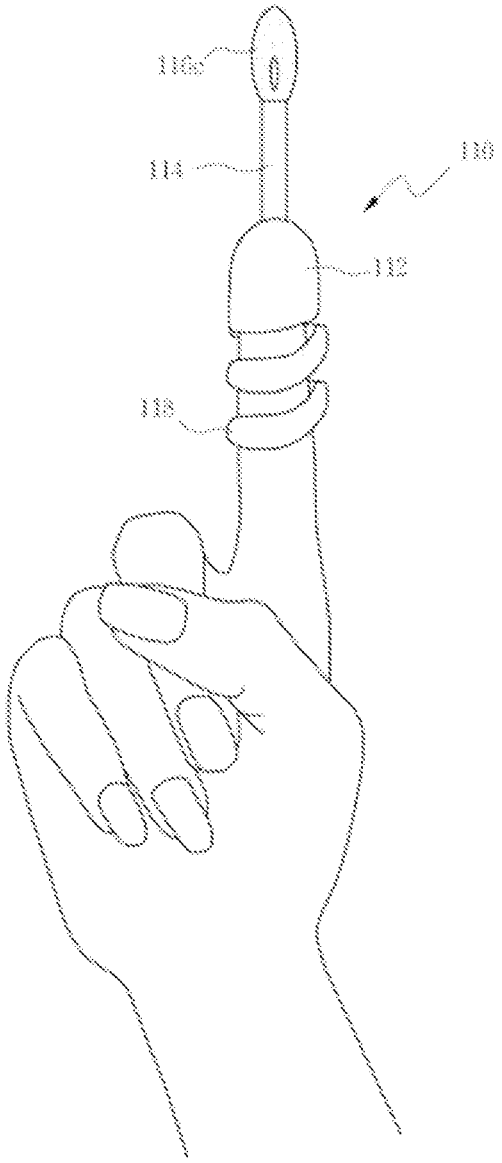
FIG. 2 is a view illustrating the use of a makeup applying tool of the makeup tool set for a handicapped person according to the exemplary embodiment of the present invention, into which a finger is inserted.

FIG. 1 is a sectional view illustrating a makeup tool set for a handicapper person according to an exemplary embodiment of the present invention, and FIG. 2 is a view illustrating the use of a makeup applying tool of the makeup tool set for a handicapped person according to the exemplary embodiment of the present invention, into which a finger is inserted.

By referring to the drawings, a makeup tool set for a handicapped person according to an exemplary embodiment of the present invention includes a makeup tool 110 used to smear and apply cosmetics to user's skin by which a finger handicapped person, especially, without a thumb inserts his/her a finger except the thumb thereinto, and a custody case 120 formed with seat grooves 122 for helping the handicapped person takes off the makeup tool 110 from fingers easily and inserts a finger into the makeup tool 110.

Particularly, the makeup tool 110 enabling the hand handicapped person to easily smear and apply cosmetic to skin includes a thimble 112 into which a finger is inserted, a tool rod 114 extending from the thimble 112, and an applying tip formed at an end of the tool rod 114.

The thimble 112 is made of an elastic material and has an opening, into which a finger is inserted, with a diameter greater than that the inside of the thimble 112 connected to the tool rod 114. The thimble 112 is preferably made of an elastic soft material such as sponge, silicone, etc., such that a user does not feel foreign body sense when a user inserts his/her finger into the thimble 112.

Preferably, the thimble 112 includes an open rear end and a streamline inner portion matching the curved end portion of a finger with a fingernail. The thimble 112 may, if necessary, include a plurality of vent holes (not shown) for air ventilation.

At the leading end of the thimble 112, the tool rod 114 of a preset length is provided and includes an applying tip 116, to which color cosmetics is applied, formed at the end of the tool rod 114. The applying tip 116, as illustrated in the drawings, may include a brush 116*a* to apply powder color cosmetics, a sponge tip 116*b* suitable for applying fine color cosmetics to skin, and an applying tip 116*c* suitable for applying liquid color cosmetics to skin such as lips while smearing the liquid color cosmetics.

Further, in order to support the thimble 112 more securely and to prevent the thimble 112 into which a finger is inserted from moving for the more elaborated color makeup, the thimble 112 includes an elastic support 118.

Particularly, since the elastic support 118 is formed at the opening of the thimble 112 into which a finger is inserted, the elastic support 118 has preferably a coil spring-like shape spirally wrapping a finger.

As such, since the elastic support 118 is formed at the opening of the thimble 112 into which a finger is inserted, the elastic support 118 wraps and supports the finger when the finger is inserted into the thimble 112 so that the thimble 112 can be more securely supported on the finger and that, when a user bends his/her finger, the elastic support 118 moves as much as an angle the bent finger and the user do not feel uncomfortable.

Meanwhile, there is provided a custody case 120 in which a user keeps the makeup tool 110. The custody case 120 is a hollow semi-spherical and includes seat grooves 122 in which the makeup tool 110 are seated and through-holes 124 formed inward the inside the custody case 120 in the seat grooves 122.

The seat grooves 122 on the surface of the custody case 120 are depressed on the surface of the custody case 120 to match the thimbles 112 of the makeup tools 110 and the through-holes 124 are formed in the seat grooves 122 such that the tool rods 114 extending from the thimbles 112 and the applying tips 116 penetrate the seat grooves 122 and are inserted into the custody case 120.

After using the makeup tool 110, the tool rod 114 including the applying tip 116 of the makeup tool 110 is inserted into the custody case 120 to be placed in the custody case 120 and to seat the thimble 122 in the seat groove 122.

When a user uses the makeup tool 110 mounted in the custody case 120, the user inserts a finger into the thimble 112 and takes the finger wearing the makeup tool 110 off from the seat groove 122 and apples color cosmetics with the applying tip 116.

According to the makeup tool set for a handicapped person of the present invention, since a user, particularly a hand handicapped person who cannot grasp the makeup tool 110 applying color cosmetics to corresponding skin can insert a finger into the thimble 112, the hand handicapped person can makeup conveniently without wrapping the makeup tool 110 and can keep the makeup tool 110 conveniently by mounting the thimble 112 in the seat groove 122.

While this invention has been particularly shown and described with reference to preferred embodiments thereof, these embodiments are provided so that this disclosure will be thorough and complete, and will fully convey the concept of the invention to those skilled in the art. It will be understood by those skilled in the art that various changes in form and details may be made therein without departing from the spirit and scope of the invention as defined by the appended claims.

What is claimed is:

1. A makeup tool set for a handicapped person comprising:

a makeup tool for a finger having a thimble for the finger, a tool rod extending from a tip of the thimble, and an applying tip at the end of the tool rod, the thimble having a coil spring extending in the direction from which the finger is inserted; and a custody case to receive the makeup tool, the custody case having a central hollow space and at least one opening configured to hold a portion of the thimble so that the tool rod and the applying tip are hung inside the central hollow space.

2. The makeup tool set according to claim 1, wherein the thimble is made of an elastic material.

3. The makeup tool set according to claim 1, wherein the custody case has a curved surface, the at least one opening disposed in the curved surface.

4. The makeup tool set according to claim 1, wherein the at least one opening in custody case has a first portion and a second portion, the first portion being larger than the second portion, the first portion to receive at least a portion of the thimble and the second portion for receiving at least a portion of the tool rod.

5. The makeup tool set according to claim 1, wherein the at least one opening comprises three openings.

6. A makeup tool set for a handicapped person comprising:

a makeup tool for a finger having a thimble for the finger and an elastic support extending in the direction from which the finger is inserted, a tool rod extending from a tip of the thimble, and an applying tip at the end of the tool rod, the thimble having a coil spring extending in the direction from which the finger is inserted; and a custody case to receive the makeup tool, the custody case having a curved surface and at least one opening disposed in the curved surface, the at least one opening configured to hold a portion of the thimble, the custody case also having an interior space adjacent the curved surface to receive a portion of the tool rod and the applying tip through the at least one opening.

7. The makeup tool set according to claim 6, wherein the at least one opening comprises three openings.

8. The makeup tool set according to claim 6, wherein the at least one opening in custody case has a first portion and a second portion, the first portion being larger than the second portion and configured to receive at least a portion of the thimble and the second portion configured to receive at least a portion of the tool rod.

* * * * *